US007577386B2

(12) United States Patent
Li et al.

(10) Patent No.: US 7,577,386 B2
(45) Date of Patent: Aug. 18, 2009

(54) TONER CARTRIDGE

(75) Inventors: Kuan-Tung Li, Taichung County (TW); Chun-Tien Liu, Taichung County (TW); Yueh-Chun Lee, Taichung County (TW)

(73) Assignee: General Plastic Industrial Co., Ltd., Taichung County (TW)

( * ) Notice: Subject to any disclaimer, the term of this patent is extended or adjusted under 35 U.S.C. 154(b) by 178 days.

(21) Appl. No.: 11/742,740

(22) Filed: May 1, 2007

(65) Prior Publication Data

US 2008/0273899 A1 Nov. 6, 2008

(51) Int. Cl.
*G03G 15/08* (2006.01)

(52) U.S. Cl. ..... 399/262; 399/120; 399/258; 399/260

(58) Field of Classification Search ..... 399/262, 399/120, 263, 261; 222/DIG. 1
See application file for complete search history.

(56) References Cited

U.S. PATENT DOCUMENTS 6,134,411 A * 10/2000 Meyer et al. ..... 399/262
6,137,978 A * 10/2000 Tsuchiya et al. ..... 399/258
6,424,812 B1 * 7/2002 Hsu ..... 399/262
2001/0008593 A1 * 7/2001 Tsuji et al. ..... 399/262
2003/0103782 A1 * 6/2003 Dilanni et al. ..... 399/262
2003/0156861 A1 * 8/2003 Nagano et al. ..... 399/262
2006/0251448 A1 * 11/2006 Kawamura et al. ..... 399/262

* cited by examiner

*Primary Examiner*—David M Gray
*Assistant Examiner*—Rodney Bonnette
(74) *Attorney, Agent, or Firm*—Browdy and Neimark, P.L.L.C.

(57) ABSTRACT

A toner cartridge includes a container defining a central axis and a toner-guiding member. The container is provided at one end thereof with an opening having a radius. The toner-guiding member is provided with an annular connecting portion connected with the container, an outlet at one end thereof, a longitudinally-extending portion at the other end thereof extending into the container through the opening, an inlet formed on the longitudinally-extending portion, and a flexible scraping piece mounted on the longitudinally-extending portion and adjacent to the inlet. The scraping piece has a distal end defining with the central axis a distance longer than the radius of the opening, such that the toner in the container can be substantially fully discharged out of the toner cartridge so as to lower the residual quantity of toner in the toner cartridge.

3 Claims, 4 Drawing Sheets

TONER CARTRIDGE

BACKGROUND OF THE INVENTION

1. Field of the Invention

The present invention relates generally to a toner cartridge and more specifically, to a toner cartridge that can effectively discharge toner to lower the residual quantity of toner therein.

2. Description of the Related Art

U.S. Pat. No. 6,137,978 discloses a toner cartridge mainly comprising a toner storing container for accommodation of toner, and a solid lid coupled to the toner storing container. The toner storing container is provided at an inner periphery surface thereof with a plurality of spiral protrusions for forcing the toner to move forwards when the toner storing container is rotated. The solid lid is provided with an outlet, an annular connecting portion coupled with the toner storing container, and two scraping members having respectively an inlet. One of the scraping members has a top blade adjacent to the inlet. When the toner cartridge is rotated, the toner in the toner storing container can be moved by the top blade into the scraping members or directly enter the scraping members through the inlets, and subsequently slide along beveled surfaces of the two scraping members to the outlet due to gravity.

However, in consideration of the possibility of demold in manufacturing, a gap has to be left between the top blade of the solid lid and the inner periphery of the annular connecting portion, resulting in that the top blade cannot guide all of the toner to the two scraping members, thereby causing a certain amount of toner resided in the toner cartridge. Thus, it is a need to provide an improved toner cartridge that does not have the aforesaid drawbacks.

SUMMARY OF THE INVENTION

The present invention has been accomplished in view of the above-noted circumstances. It is therefore one objective of the present invention to provide a toner cartridge, which can effectively discharge toner to lower the residual quantity of toner therein.

To achieve this objective of the present invention, the toner cartridge comprises a container and a toner-guiding member. The container is an elongated member extending along a central axis thereof and provided at one end thereof with an opening, which defines a radius. The toner-guiding member is provided at a middle part thereof with an annular connecting portion, which is coupled with the container for closing the opening, an outlet at one end thereof, a longitudinally-extending portion at the other end thereof, which extends into the container through the opening, an inlet formed on the longitudinally-extending portion, and a flexible scraping piece mounted on the longitudinally-extending portion and adjacent to the inlet. A distance is defined between a distal end of the scraping piece and the central axis. The distance is longer than the radius of the opening. Therefore, the toner in the container can be almost discharged out of the container by the toner-guiding member, thereby lowering the residual quantity of toner in the toner cartridge.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
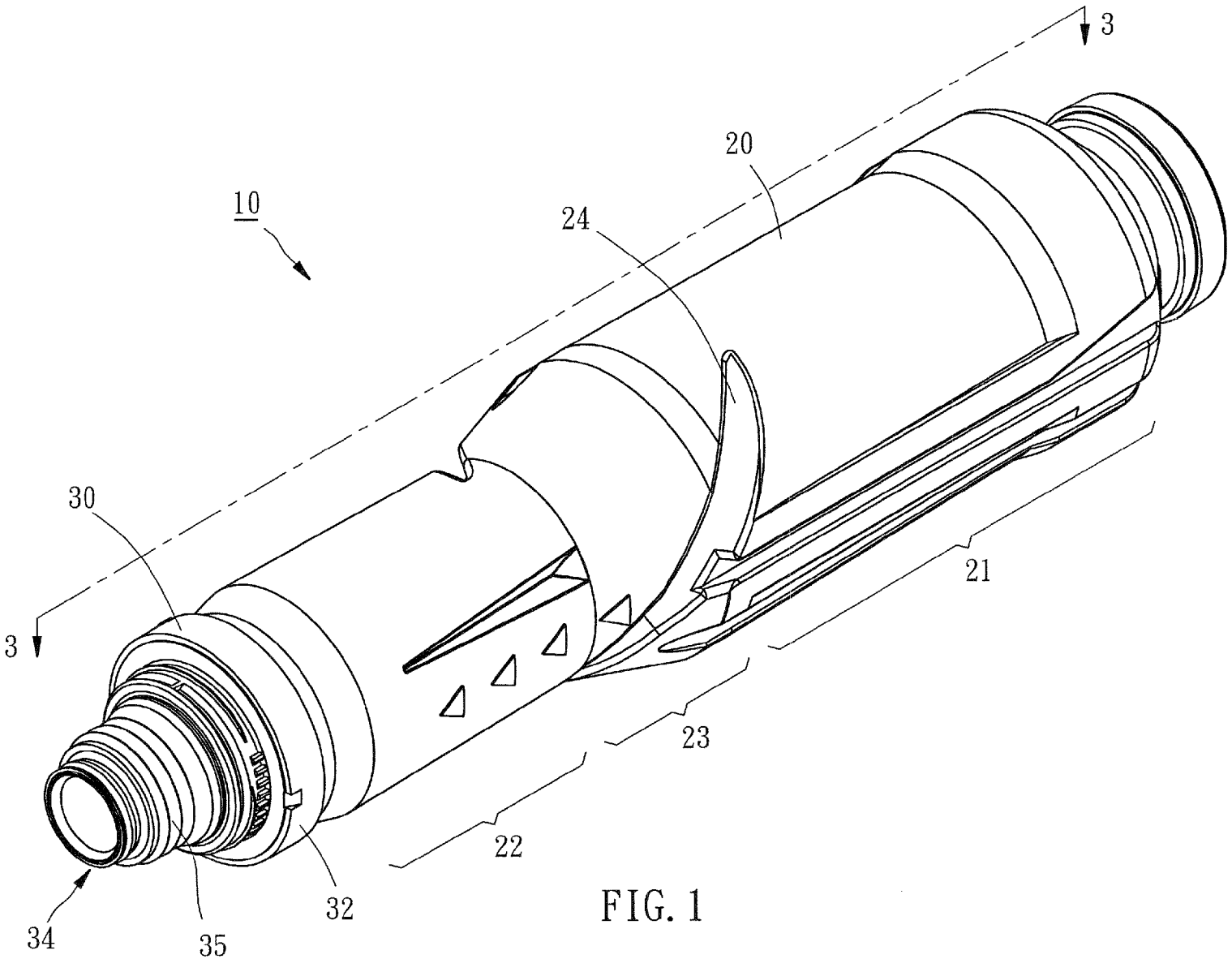
FIG. 1 is a perspective view of a preferred embodiment of the present invention.
Figure 2:
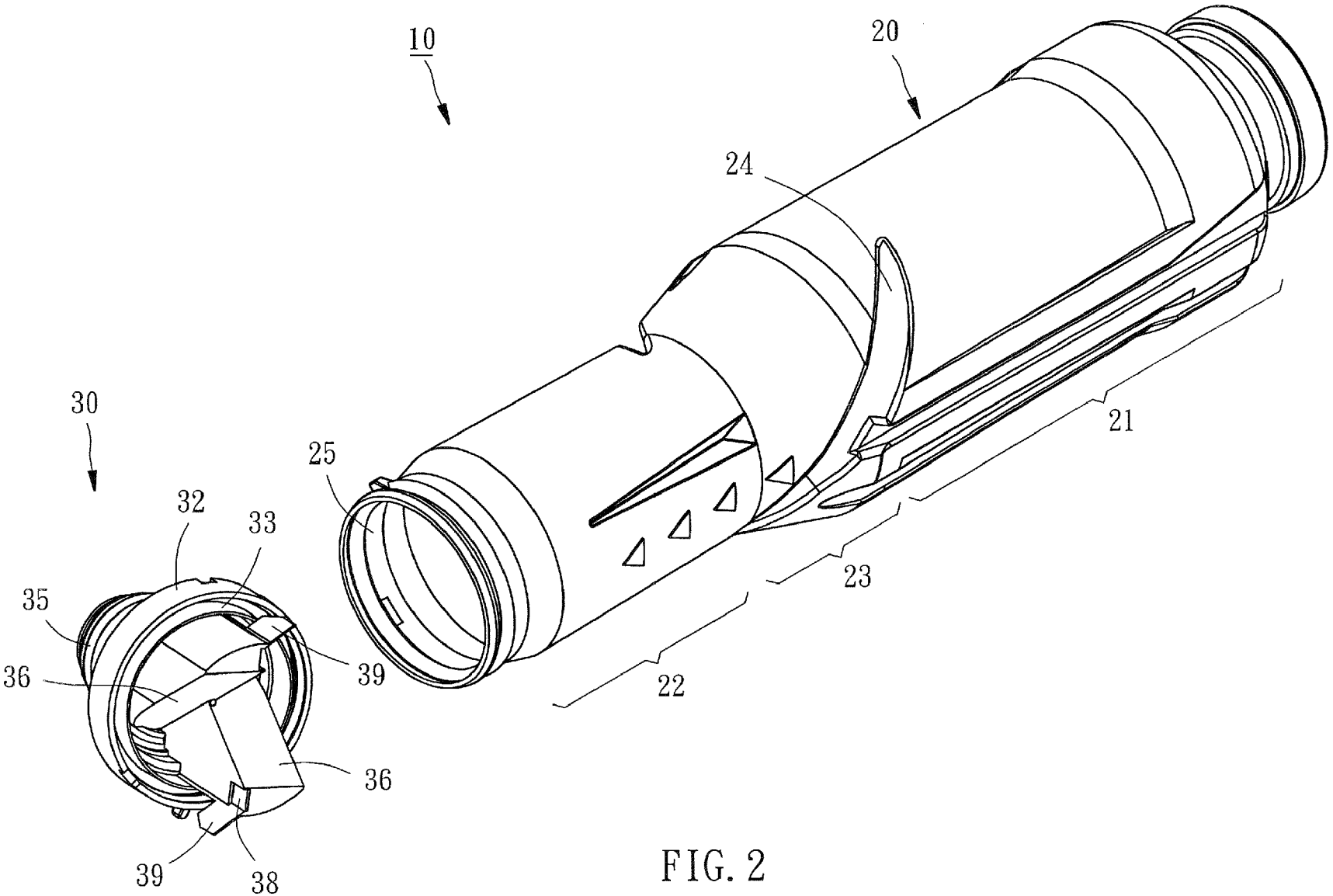
FIG. 2 is an exploded view of the preferred embodiment of the present invention.
Figure 3:
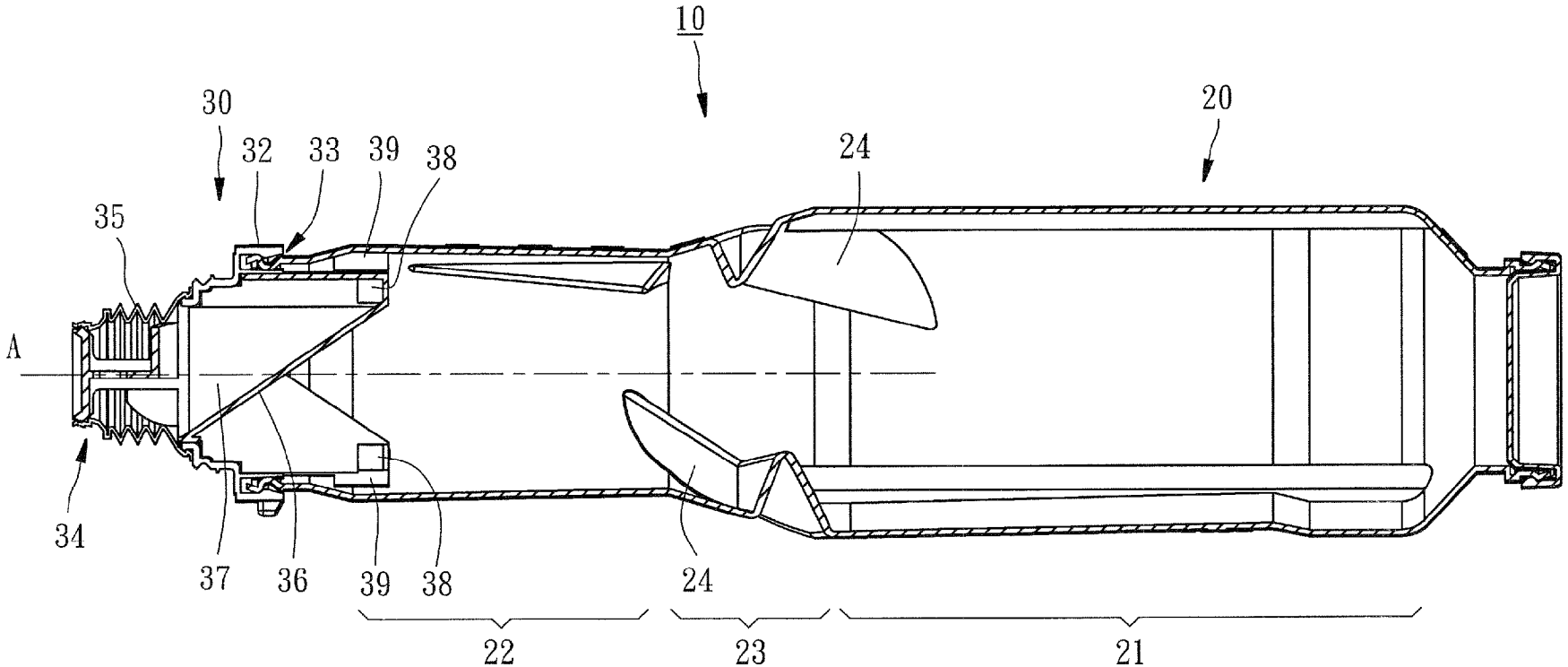
FIG. 3 is a sectional view taken along line 3-3 of FIG. 1.

As shown in FIG. 1 to FIG. 3, a toner cartridge 10 in accordance with a preferred embodiment of the present invention comprises a container 20 and a toner-guiding member 30.

The container 22 is shaped like a hollow elongated member extending along a central axis A thereof for accommodation of toner (not shown) therein. The container 20 has a first section 21, a second section 22, a connecting section 23 integrally connected between the first section 21 and second section 22, two guiding flaps 24 spacedly and slantingly extending from the first section 21 to the second section 22 via the connecting section 23, and an opening 25 at a front end thereof defining a radius R. The cross-section area of the first section 21 and the cross-section area of the second section 22 both gradually increase toward the opening 25, and the cross-section area of the connecting section 23 gradually decreases toward the opening 25. When the container 20 is horizontally installed in an image-forming apparatus and rotated, the toner can naturally move from a rear end of the first section 21 to a front end of the first section 21 due to gravity, and be subsequently forced by the two guiding flaps 24 to move from the front end of the first section 21 to a rear end of the second section 22 via the connecting section 23, and then naturally move to a front end of the second section 22 due to gravity.

The toner-guiding member 30 is provided at a middle part thereof with an annular connecting portion 32, which is coupled with the container 20 for closing the opening 25 and provided with an insertion groove 33 for insertion of the front end of the container 20, an outlet 34 at a front end thereof, an accordion tube 35 telescopically extending forward from the annular connecting portion 32 and closing the outlet 34 at a normal position, two longitudinally-extending portions 36 at a rear end thereof, each of which extends through the opening 25 into the container 20 and has a chamber 37 in communication with the outlet 34, two inlets 38 respectively formed on the two longitudinally-extending portions 36, and two flexible scraping pieces 39 respectively mounted on the two longitudinally-extending portions 36 and adjacent to the two inlets 38 respectively.

Figure 4:
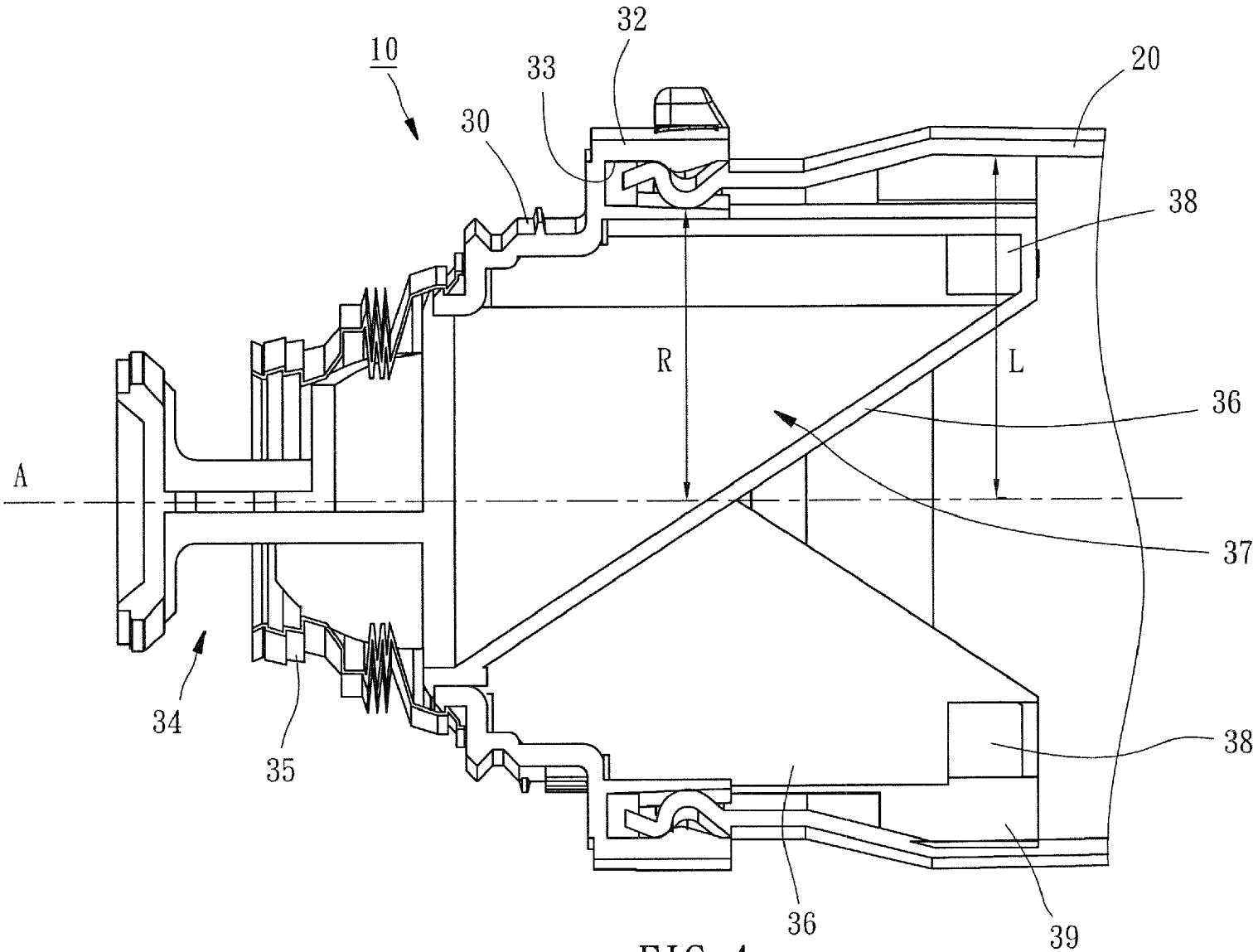
FIG. 4 is an enlarge view of a part of FIG. 3, showing the toner-guiding member coupled with the container.

The accordion tube 35 normally closes the outlet 34; however, when the toner cartridge 10 is installed in an image-forming apparatus, such as photocopier, the accordion tube 35 will be pushed by a mating member to retract backwards so as to open the outlet 34, as shown in FIG. 4. In addition, because each longitudinally-extending portion 36 extends backward from the connecting portion 32 with a predetermined distance, which is about 3 cm in this embodiment, the two scraping pieces 39 respectively, slantingly and outwardly extend from a distal end of each longitudinally-extending portion 36. Further, as shown in FIG. 2 and FIG. 4, a distance L is defined between the distal end of the scraping piece 39 and the central axis A, and the distance L is longer than the radius R of the opening 25 such that the two scraping pieces 39 are elastically in contact with an inner periphery of the container 20 when the toner-guiding member 30 and the container 20 are assembled together.

Accordingly, when the toner cartridge 10 is horizontally installed in the image forming apparatus (not shown) and rotated, the toner can be moved by the two scraping pieces 39 to the chambers 37 of the two longitudinally-extending portions 36 through the two inlets 38, and then naturally slide to the outlet 34 due to gravity. Because the two scraping pieces 39 are closely in contact with the inner periphery of the container 20, all of the toner in the container 20 can be almost forced by the scraping pieces 39 to enter longitudinally-extending portions 36, thereby lowering the residual quantity of toner in the container 20. By means of the aforesaid design, the toner cartridge provided by the present invention can improve the defect of the prior art toner cartridge and achieve the objective of the present invention. It is to be understood that a gap may be caused between each scraping piece 39 and the inner periphery of the container 20 due to possible elasticity fatigue of the two scraping pieces 39, minor accumulation of toner between each scraping piece 39 and the inner periphery of the container 20 or other reason after the toner cartridge is used for a long time. This problem can be easily solved by selecting the material for the scraping piece and does not mean that the described toner cartridge can not achieve the objective of the present invention.

The toner cartridge can be made with various kinds of design on the basis of the spirit of the present invention. For example, the container can be provided at the inner periphery thereof with a plurality of spiral guiding ribs for forcing the toner to move forward. Furthermore, the toner-guiding member can be provided with one or more longitudinally-extending portions. In addition, in the above-described embodiment the distance L is longer than the radius R of the opening 25 and the two scraping pieces 39 are elastically in contact with the inner periphery of the container 20. However, in actual practice the toner cartridge can be alternatively designed to have the distance be longer than the radius of the opening but the distal ends of the two scraping pieces be substantially slightly spaced from the inner periphery of the container, which can also achieve the objective of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner cartridge comprising:

a container defining a central axis and provided at a front end thereof with an opening defining a radius; and a toner-guiding member fixedly mounted to the container, the member comprising an annular connecting portion at a middle part thereof coupled with the container for closing the opening, an outlet at one end thereof, at least one longitudinally-extending portion at the other end thereof fixedly mounted on the toner-guiding member and extending into the container through the opening, an inlet formed on the at least one longitudinally-extending portion, and a flexible scraping piece mounted on the at least one longitudinally-extending portion and adjacent to the inlet;

wherein the scraping piece has a distal end defining with the central axis a distance that is longer than the radius of the opening.

2. The toner ca ridge as claimed in claim 1, wherein the toner-guiding member comprises two said longitudinally-extending portions, each of which has one said inlet and is mounted with one said scraping piece.

3. The toner cartridge as claimed in claim 1, wherein the scraping piece of the toner-guiding member is substantially in contact with an inner periphery of the container.

* * * * *